United States Patent [19]

Sakagawa et al.

[11] Patent Number: 4,868,725

[45] Date of Patent: Sep. 19, 1989

[54] MOTOR VEHICLE COMBINATION LAMP

[75] Inventors: Hiroaki Sakagawa; Hideaki Satsukawa, both of Shizuoka, Japan

[73] Assignee: Koito Manufacturing Co., Ltd., Tokyo, Japan

[21] Appl. No.: 265,166

[22] Filed: Oct. 31, 1988

[51] Int. Cl.[4] ..... F21V 9/00

[52] U.S. Cl. ..... 362/231; 362/61; 362/243; 362/293; 362/360

[58] Field of Search ..... 362/61, 80, 237, 240, 362/242, 243, 293, 268, 360, 310, 311, 231; 340/468, 475, 479

[56] References Cited

U.S. PATENT DOCUMENTS 3,487,206 12/1969 Dawson et al. ..... 362/80
4,241,388 12/1980 Green ..... 362/268
4,558,401 12/1985 Tysoe ..... 362/290
4,656,567 4/1987 Morris ..... 362/293 X

*Primary Examiner*—Stephen F. Husar
*Attorney, Agent, or Firm*—Sughrue, Mion, Zinn, Macpeak & Seas

[57] ABSTRACT

A combination lamp in which the lamps forming the combination lamp emit respective red and amber colors as required by applicable official regulations when turned on, but in which the entire combination lamp appears amber when the lamps are turned off, thereby improving the external appearance of the lamp. The combination lamp includes a lamp for emitting red light and a lamp for emitting amber light in which the outer lens of the lamp for emitting red light is colored amber and the inner lens thereof is colored red.

5 Claims, 2 Drawing Sheets

MOTOR VEHICLE COMBINATION LAMP

BACKGROUND OF THE INVENTION

The present invention relates to a motor vehicle combination lamp which includes a combination of a red-emitting lamp such as a tail lamp, stop lamp or rear fog lamp, and an amber-emitting lamp such as a turn signal lamp.

In a conventional lamp of the type to which the invention pertains, the front lens of the red-emitting lamp is colored red while the front lens of the amber-emitting lamp is colored amber to provide the lamp with the desired two-color function. However, the conventional lamp cannot be truly said to be a combination lamp in that, when the lamp bulbs are both turned off, it is still possible to discern the red and amber colors of the two front lenses, that is, it appears as if two separate lamps were provided.

SUMMARY OF THE INVENTION

Accordingly, it is an object of the present invention to overcome the drawbacks of the conventional combination lamp and to provide a combination lamp having an excellent external appearance. Specifically, it is an object of the present invention to provide a combination lamp in which the lamps forming the combination lamp emit their respective colors as required by applicable official regulations when turned on, but in which the entire combination lamp appears amber when the two lamps are turned off, making the lamp truly a combination lamp.

The foregoing and other objects of the invention are met by the provision of a motor vehicle combination lamp comprising a lamp for emitting red light and a lamp for emitting amber light in which, in accordance with the invention, the outer lens of the lamp for emitting red light is colored amber and the inner lens thereof is colored red.

DESCRIPTION OF THE PREFERRED EMBODIMENTS

Preferred embodiments of the invention will now be described in detail with reference to the accompanying drawings.

Figure 1:
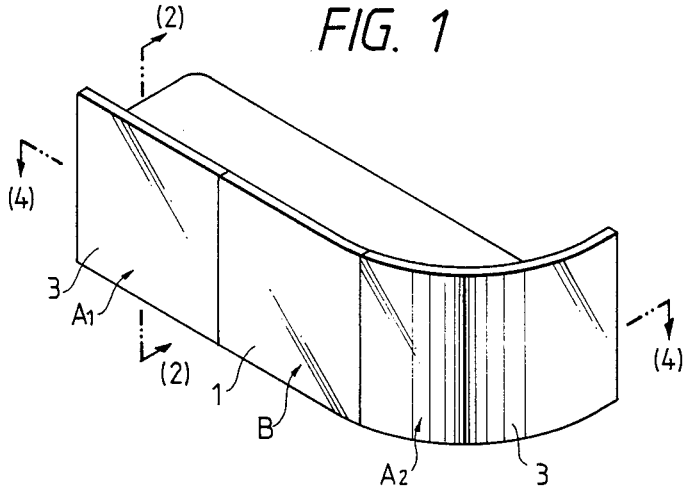
FIG. 1 shows a perspective view of a first embodiment of a motor vehicle combination lamp constructed according to the present invention.

A first embodiment of a motor vehicle combination lamp constructed in accordance with the teachings of the present invention, as shown in FIG. 1, includes a rear fog lamp $A_1$ emitting red light, a tail/stop lamp $A_2$ emitting red light, and a turn signal lamp B emitting amber light and which is disposed between the lamps $A_1$ and $A_2$. These three lamps are constructed as a single unit.

The turn signal lamp B emitting amber light is designed so that, similar to a conventional combination lamp, its front (outer) lens is colored amber to provide the amber color required by federal regulations.

In each of the rear fog lamp $A_1$ and the tail/stop lamp $A_2$, an outer lens 3 and an inner lens 4 are arranged parallel to one another in front of a light source bulb 2. The outer lens 3 is colored amber, while the inner lens 4 is colored red to provide the required red color light beam when the light source bulb 2 is turned on.

Figure 2:
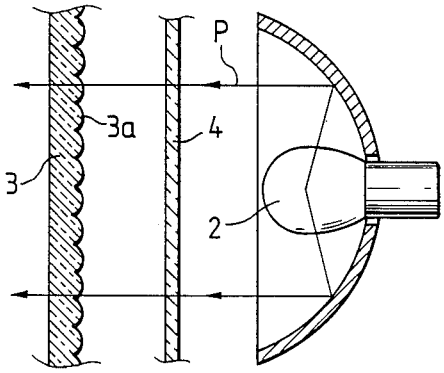
FIG. 2 is an enlarged sectional view taken along a line (2)—(2) in FIG. 1.

As shown in FIG. 2, fish-eye lens steps 3*a* are formed on the inner wall of the outer lens 3, and the outer lens 3 is colored amber. The inner lens 4 has no steps formed in either surface, and it is colored red. Therefore, when the light source bulb 2 is turned on, the output light beam of the bulb 2 is colored red when the light passes through the inner lens 4, and a red beam is emitted to the exterior, although perhaps somewhat amber-tinted due to its passing through the outer lens 3. In the lamp shown in FIG. 2, a conventional colored filter may be employed for the inner lens 4.

Figure 3:
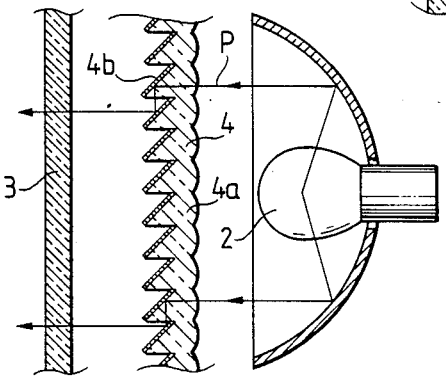
FIG. 3 is a sectional view showing a second preferred embodiment of the invention.
Figure 4:
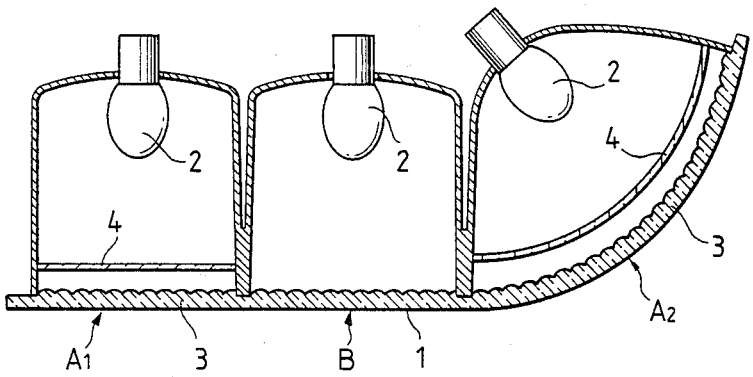
FIG. 4 is a sectional view taken along a line (4)—(4) in FIG. 1.

FIG. 3 shows a second embodiment of the invention. In this embodiment, an amber-colored smooth-surfaced outer lens 3 is employed. An inner lens 4 has fish-eye lens steps 4*a* formed on its inner surface (facing the light source bulb 2) and triangular prisms 4*a* on its outer surface (facing the outer lens 3). The inner lens 4 is colored red. Reflecting films 4*b* are formed on the sloped surfaces of the prisms.

Accordingly, when output light from the light source bulb 2 passes through the inner lens 4, it is converted into a red light beam. The red light beam, being reflected by the reflecting films 4*b*, is applied to the outer lens 3. Thus, a red light beam emerges from the outer lens 3, although its red color may be somewhat tinted amber since the beam passes through the amber outer lens 3. In the lamp shown in FIG. 3, the inner lens 4 may be transparent and have smooth surface (no steps formed in either surface).

Figure 5:
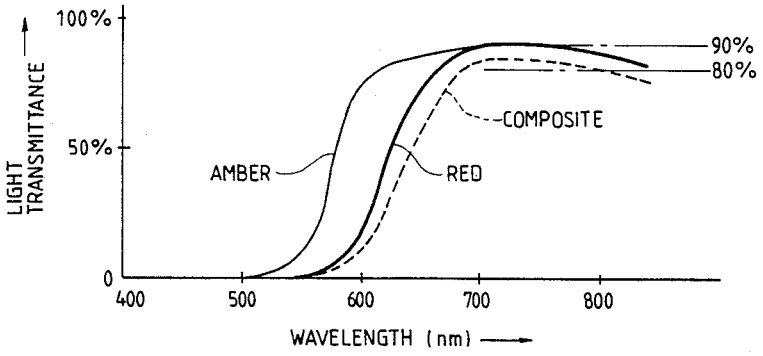
FIG. 5 is a graphical representation showing spectral distributions.

In the case where the outer lens 3 is colored amber and the inner lens 4 is colored red, the optical transmittance of the outer lens 3 is made to be about 60 to 70% and the optical transmittance of the inner lens 4 is set to about 20 to 50% in consideration of the spectral distributions of amber and red, as shown in FIG. 5. As a result, when the light source bulb 2 is turned on, a red light beam of the order of 20% is emitted.

With the motor vehicle combination lamp as described above, in each of the red-emitting lamps, a red light beam is emitted as required by federal regulations, although the red color may be somewhat tinted with amber due to the fact that the light passes through the amber-colored outer lens. When the light source bulbs of the red-emitting lamps are turned off, only the amber color of the outer lens is observed, giving the lamp an excellent external appearance. That is, the lamp of the invention can truly be termed a combination lamp.

What is claimed is:

1. A motor vehicle combination lamp comprising: a lamp for emitting red light; a lamp for emitting amber light; an red-colored inner lens for said lamp for emitting red light; and an amber-colored outer lens for both said lamps.

2. The motor vehicle combination lamp of claim 1, wherein said red-colored inner lens has smooth surfaces and said amber-colored outer lens has fish-eye lens steps formed in its inner surface.

3. The motor vehicle combination lamp of claim 1, wherein said red-colored innerlens has fish-eye lens steps formed in its inner surface and triangular prisms formed in its outer surface, and said amber-colored outer lens has smooth surfaces.

4. The motor vehicle combination lamp of claim 3, wherein reflecting films are formed on sloped surfaces of said prisms.

5. The motor vehicle combination lamp of claim 1, wherein an optical transmittance of said amber-colored outer lens is about 60 to 70% and an optical transmittance of said red-colored inner lens is about 20 to 25%.

* * * * *